US009476598B2

(12) United States Patent
Paller

(10) Patent No.: US 9,476,598 B2
(45) Date of Patent: Oct. 25, 2016

(54) OVEN APPLIANCE AND METHOD FOR OPERATING AN OVEN APPLIANCE

(71) Applicant: General Electric Company, Schenectady, NY (US)

(72) Inventor: Hans Juergen Paller, Louisville, KY (US)

(73) Assignee: Haier U.S. Appliance Solutions, Inc., Wilmington, DE (US)

( * ) Notice: Subject to any disclaimer, the term of this patent is extended or adjusted under 35 U.S.C. 154(b) by 525 days.

(21) Appl. No.: 14/031,246

(22) Filed: Sep. 19, 2013

(65) Prior Publication Data

US 2015/0075509 A1 Mar. 19, 2015

(51) Int. Cl.
*F24C 3/12* (2006.01)
*F24C 14/02* (2006.01)

(52) U.S. Cl.
CPC ..... *F24C 14/025* (2013.01); *F24C 3/122* (2013.01); *F24C 3/126* (2013.01)

(58) Field of Classification Search
CPC ..... F24C 3/122; F24C 14/025
USPC ..... 126/42; 99/337
See application file for complete search history.

(56) References Cited

U.S. PATENT DOCUMENTS

RE27,545 E * 1/1973 Guy ..... H01H 19/62 219/412
7,479,006 B2 * 1/2009 Newsom ..... F23N 1/00 126/39 N

* cited by examiner

*Primary Examiner* — William G Corboy
(74) *Attorney, Agent, or Firm* — Dority & Manning, P.A.

(57) ABSTRACT

Oven appliances and methods for operating oven appliances are provided. A method includes determining if a cooktop burner is active during operation of a cooking chamber self-clean cycle. The method further includes deactivating the self-clean cycle if the cooktop burner is active, and continuing the self-clean cycle if the cooktop burner is not active.

17 Claims, 3 Drawing Sheets

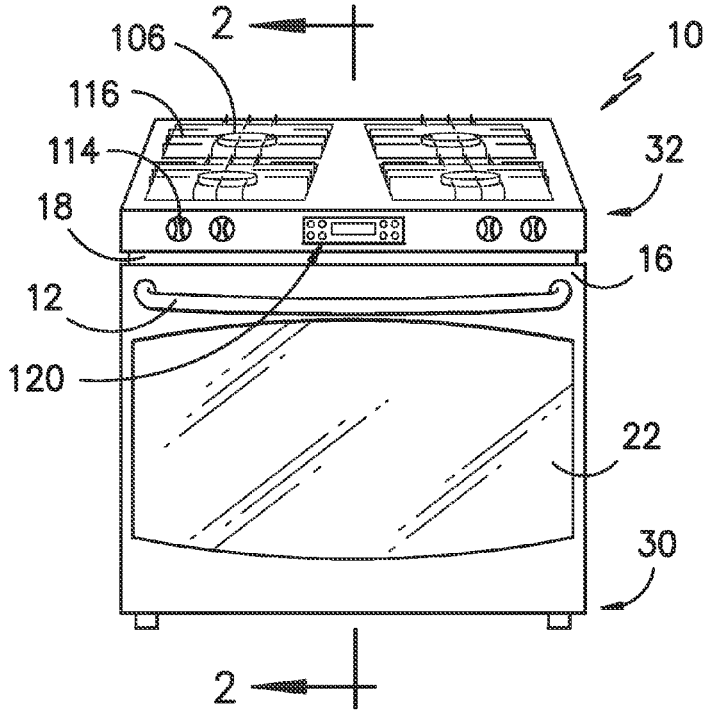
FIG. —1—
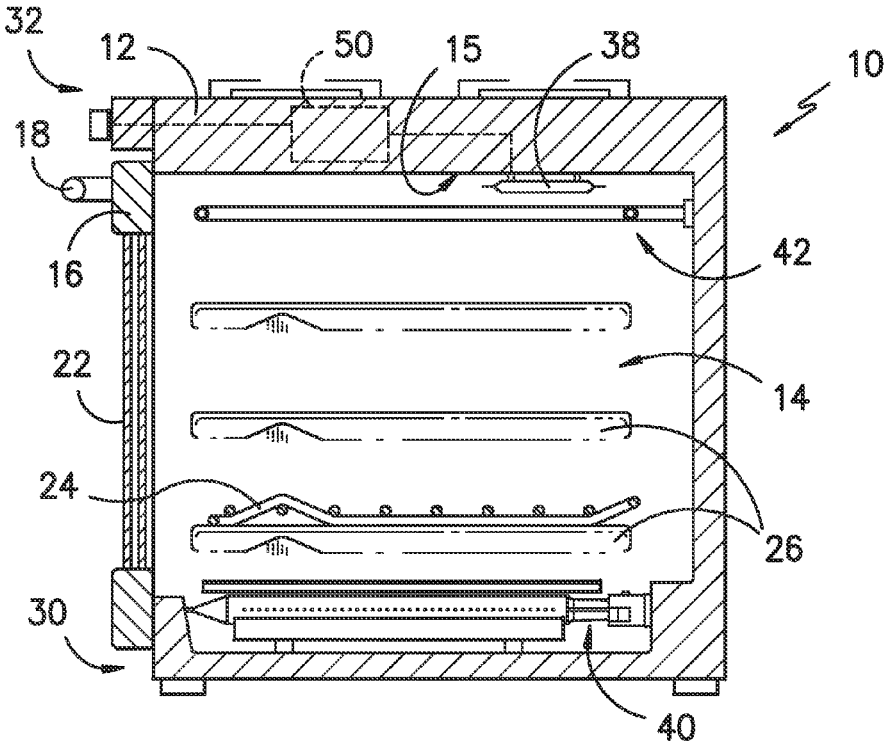
FIG. —2—

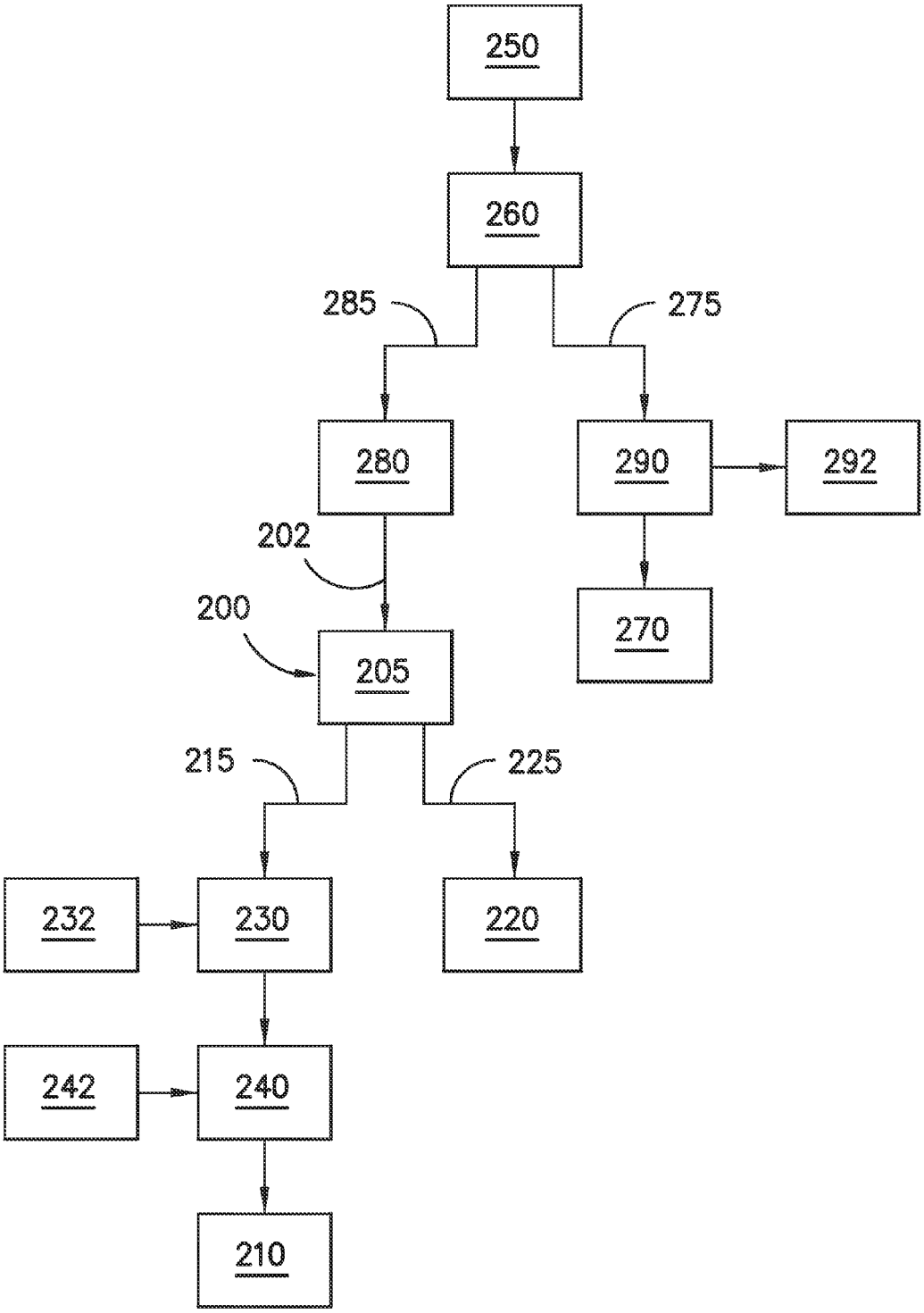
FIG. —4—

OVEN APPLIANCE AND METHOD FOR OPERATING AN OVEN APPLIANCE

FIELD OF THE INVENTION

The present subject matter relates generally to oven appliances, such as gas oven appliances having cooking chambers and cooktop burner assemblies. More particularly, the present subject matter relates generally to operation of the oven appliances during self-clean cycles thereof.

BACKGROUND OF THE INVENTION

Oven appliances are frequently utilized in a variety of settings to cook food items. During operation of an oven appliance, relatively high temperatures can be generated in, for example, the cooking chamber of the oven appliance. Specifically, many known oven appliances include self-clean cycles. During a self-clean cycle, the heating elements in the cooking chamber can generate heat such that temperatures in the chamber can reach extremely high levels, such as in excess of 800 degrees Fahrenheit. Such levels can approach the temperature limits of various components of the oven appliance, such as the chamber and cabinet surfaces and walls.

One concern during operation of oven appliances is the operation of other components of the oven appliance during a self-clean cycle. For example, an oven appliance may include one or more cooktop burners. If a burner is operated during a self-clean cycle, the overall temperatures generated by the oven appliance may exceed the temperature limits of the oven appliance. Additionally, such operation and high temperatures can be dangerous to user of the oven appliance.

Attempts have been made to prevent additional usage of oven appliances during self-clean cycles. For example, in the case of fuel-based burners, lockout valves have been installed and coupled to the valves utilized to provide fuel to the burners. In the case of electric burners, similar lockout switches have been provided. Activation of a self-clean cycle has been utilized to activate the lockout valves or switches, which prevent fuel or electricity from being provided to the burners. However, such approaches have disadvantages. For example, lockout valves and switches are expensive to obtain and install. Further, such mechanical solutions risk damage and failure, and are thus considered unreliable.

Accordingly, improved oven appliances and methods for operating oven appliances are desired in the art. Specifically, improved oven appliances and methods for ensuring that other oven appliance operations, such as cooktop operations, do not occur during self-clean cycles would be advantageous.

BRIEF DESCRIPTION OF THE INVENTION

In accordance with one embodiment of the present disclosure, a method for operating an oven appliance is provided. The method includes determining if a cooktop burner is active during operation of a cooking chamber self-clean cycle. The method further includes deactivating the self-clean cycle if the cooktop burner is active, and continuing the self-clean cycle if the cooktop burner is not active.

In accordance with another embodiment of the present disclosure, a method for operating an oven appliance is provided. The method includes determining if a cooktop burner is active during operation of a cooking chamber self-clean cycle, and displaying a deactivation warning and initiating a deactivation countdown timer if the cooktop burner is active. The method further includes deactivating the self-clean cycle if the deactivation countdown timer expires, and continuing the self-clean cycle if the cooktop burner is not active.

In accordance with another embodiment of the present disclosure, an oven appliance is provided. The oven appliance includes a cabinet defining a cooking chamber, the cooking chamber configured for receipt of items to be cooked, and a heating element positioned in the cooking chamber and configured for heating the cooking chamber. The heating element is operable to perform a self-clean cycle. The oven appliance further includes a cooktop disposed on the cabinet, the cooktop comprising a cooktop burner, and a controller in communication with the heating element and the cooktop burner. The controller is operable to determine if the cooktop burner is active during operation of heating element to perform the self-clean cycle. The controller is further operable to deactivate the self-clean cycle if the cooktop burner is active.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a perspective view of an oven appliance according to an exemplary embodiment of the present subject matter.

FIG. 2 provides a section view of the oven appliance of FIG. 1 taken along the 2-2 line of FIG. 1.

FIG. 4 provides a flowchart of a method for operating an oven appliance according to an exemplary embodiment of the present subject matter.

DETAILED DESCRIPTION OF THE INVENTION

Figure 3:
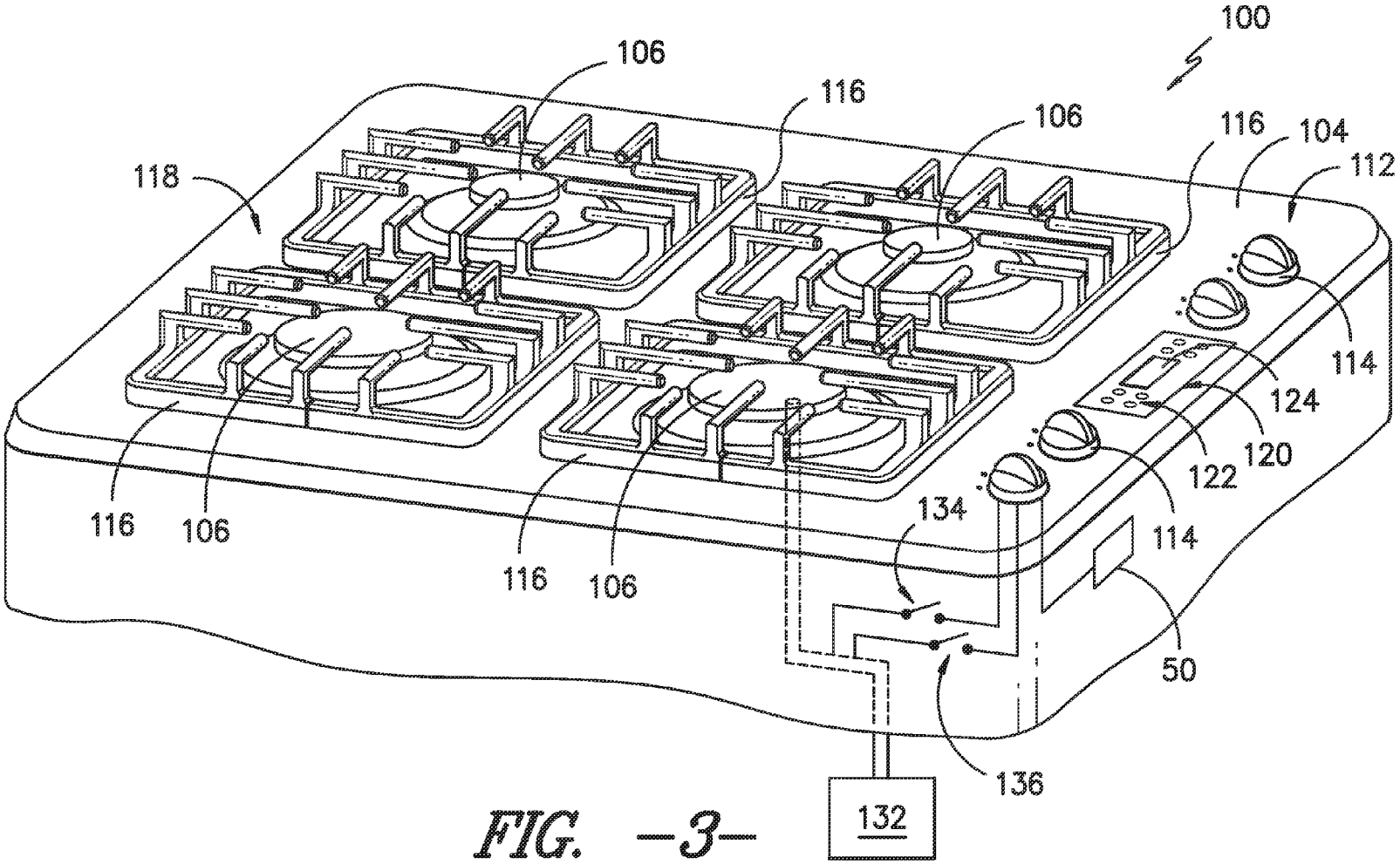
FIG. 3 provides a perspective view of an exemplary embodiment of an oven appliance cooktop according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an oven appliance 10 according to an exemplary embodiment of the present subject matter. FIG. 2 provides a section view of oven appliance 10 taken along the 2-2 line of FIG. 1. Range appliance 10 is provided by way of example only and is not intended to limit the present subject matter in any aspect. Thus, the present subject matter may be used with other oven appliance configurations, e.g., that define one or more interior cavities for the receipt of food and/or having different pan or rack arrangements than what is shown in FIG. 2. Further, the present subject matter may be used in any other suitable appliance.

Oven appliance 10 includes an insulated cabinet 12 with an interior cooking chamber 14 defined by an interior surface 15 of cabinet 12. Cooking chamber 14 is configured for the receipt of one or more food items to be cooked. Range appliance 10 includes a door 16 rotatably mounted to cabinet 12, e.g., with a hinge (not shown). A handle 18 is mounted to door 16 and assists a user with opening and closing door 16 in order to access cooking chamber 14. For example, a user can pull on handle 18 to open or close door 16 and access cooking chamber 14.

Range appliance 10 can includes a seal (not shown) between door 16 and cabinet 12 that assist with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs or sliding rails 26 such that rack 24 may be conveniently moved into and out of cooking chamber 14 when door 16 is open.

A gas fueled or electric bottom heating element 40 (e.g., a gas burner or a bake gas burner) is positioned in cabinet 12, e.g., at a bottom portion 30 of cabinet 12. Bottom heating element 40 is used to heat cooking chamber 14 for both cooking and cleaning of oven appliance 10. The size and heat output of bottom heating element 40 can be selected based on the e.g., the size of oven appliance 10.

A top heating element 42 is also positioned in cooking chamber 14 of cabinet 12, e.g., at a top portion 32 of cabinet 12. Top heating element 42 is used to heat cooking chamber 14 for both cooking/broiling and cleaning of oven appliance 10. Like bottom heating element 40, the size and heat output of top heating element 42 can be selected based on the e.g., the size of oven appliance 10. In the exemplary embodiment shown in FIG. 2, top heating element 42 is shown as an electric resistance heating element. However, in alternative embodiments, a gas, microwave, halogen, or any other suitable heating element may be used instead of electric resistance heating element 42.

The operation of oven appliance 10 including heating elements 40 and 42 is controlled by a processing device such as a controller 50, which may include a microprocessor or other device that is in communication with such components. Such controller 50 may also be communication with a temperature sensor 38 that is used to measure temperature inside cooking chamber 14 and provide such measurements to the controller 50. Temperature sensor 38 is shown (in FIG. 2) in the top and rear of cooking chamber 14. However, other locations may be used and, if desired, multiple temperature sensors may be applied as well.

Referring now to FIG. 3, oven appliance 10 may further include a cooktop 100. Cooktop 100 may be disposed on the cabinet 12. As show, cooktop 100 may include a top panel 104. By way of example, top panel 104 may be constructed of glass, ceramics, enameled steel, and combinations thereof. One or more burners 106 may be provided, and may extend through top panel 104. For cooktop 100, a utensil holding food and/or cooking liquids (e.g., oil, water, etc.) may be placed onto grates 116 disposed adjacent such burners 106. Burners 106 provide thermal energy to cooking utensils on grates 116. As shown in FIG. 3, burners 106 can be configured in various sizes so as to provide e.g., for the receipt of cooking utensils (i.e., pots, pans, etc.) of various sizes and configurations and to provide different heat inputs for such cooking utensils. Grates 116 may be supported on a top surface 118 of top panel 104.

Oven appliance 10 may further include a user interface panel 112, which may as shown be located within convenient reach of a user of the oven appliance 10. For this exemplary embodiment, panel 112 includes knobs 114 that are each associated with one of burner assemblies 106. Knobs 114 allow the user to activate each burner assembly and determine the amount of heat input provided by each burner assembly 106, 108, 109, and 110 to a cooking utensil located thereon. Panel 112 may also be provided with a control panel 120. Control panel 120 may provide visual information to a user and allow the user to select various options for the operation of various oven appliance 10 components via user inputs 122. One or more of a variety of electrical, mechanical or electro-mechanical input devices including rotary dials, push buttons, toggle/rocker switches, and/or touch pads can also be used singularly or in combination as user inputs 122. A graphical display 124 of the control panel 120 may deliver certain information to the user such as e.g., whether a particular burner 106 is activated and/or the level at which the burner 106 is set.

Although shown with knobs 114, it should be understood that knobs 114 and the configuration of cooktop appliance 100 shown in FIG. 1 is provided by way of example only. More specifically, user interface 112 may include various input components, such as one or more of a variety of touch-type controls, electrical, mechanical or electro-mechanical input devices including rotary dials, push buttons, and touch pads. The user interface 112 may include other display components, such as a digital or analog display device designed to provide operational feedback to a user.

In exemplary embodiments, each burner 106 may be a gas burner. Accordingly, a fuel line 130 may provide fluid communication between each burner 106 and a fuel source 132. Further, the knob 114 associated with each burner 106 may be in communication with the fuel line 130, such as through use of one or more switches. For example, switch 134 may detect when the knob 114 is turned to a "light" position, and thus may activate a spark module to light the fuel being supplied to the burner 106. Switch 136 may detect when the knob 114 is in an "on" position and thus allow fuel to flow to the burner 106, such that the burner 106 is activated. Alternatively, it should be noted that burner 106 may be electric burners or any other suitable burners.

Cooktop 100 shown in FIG. 3 illustrates an exemplary embodiment of the present subject matter. Thus, although described in the context of cooktop 100, the present subject matter may be used in cooktop appliances having other configurations, e.g., a cooktop appliance with one, two, or more additional burner assemblies.

The operation of burners 106 is controlled by, for example, controller 50. Such controller 50 may also be communication with knobs 114 and switches 134, 136. Thus, for example, input signals from operation of a knob 114 or operation of a switch 134, 136 may be provided to controller 50, or controller 50 may operate a knob 114 or switch 134, 136.

As discussed, one or more heating elements 40, 42 can be utilized to clean the cooking chamber 14. Such cleaning is performed during a self-clean cycle. During such cycle, one or more heating elements (typically bottom heating element 40) are activated and operated at relatively high temperatures for an extended period of time. Such operation generally burns leftover foodstuffs, etc., turning these leftovers into ash and facilitating easy removal thereof. However, improved methods and apparatus for ensuring that other oven appliance 10 operations are not performed during a self-cleaning cycle are desired.

Accordingly, and referring now to FIG. 3, the present disclosure is further directed to methods for operating oven appliances 10. Such methods prevent the simultaneous use of a cooktop burner 106 and the heating elements 40, 42 that are performing a self-clean cycle. Advantageously, methods according to the present disclosure are efficient, reliable, and affordable relative to previously known approaches.

A method according to the present disclosure may thus include the step 200 of, for example, determining if any of the one or more cooktop burners 106 is active, such as in any suitable operating state as opposed to a non-operating state, during operating of a cooking chamber 14 self-clean cycle 202. Such determining step may be performed through, for example, monitoring of the knob 114 associated with a burner 106. For example, the position of the knob 114 may be utilized to perform such step, such that the step 200 includes the step 205 determining a position of the knob 114. For example, knob 114 may be positioned such that the burner 106 is off, or may be positioned such that the burner 106 is on at a suitable level. Switch 136 may, for example, provide an indication of the position of the knob 114. Such position 114 may determine if the burner 106 is active during operating of a cooking chamber 14 self-clean cycle 202.

Alternatively, step 200 may be performed by, for example monitoring of a fuel line 130 to determine whether fuel is being supplied to a burner 106. Pressure or flow sensors could be utilized to provide such determinations. In other alternative embodiments, switch 134 could be monitored, and the sensing of a spark due to the position of the knob 114 could be utilized to provide such determinations. Further, any other suitable methods and apparatus may be utilized to determine if the burner 106 is active during operating of a cooking chamber 14 self-clean cycle 202.

It should be understood that controller 50 may in exemplary embodiments be utilized to perform the determining step 200. For example, knobs 114, switches 134, 136, and fuel line 130 may be in communication with controller 50. Controller 50 may thus detect, for example, the position of the knob 114 or another suitable indication that a burner 106 is active. Controller 50 may provide this detection during operation of the self-clean cycle 202.

A method according to the present disclosure may further include, for example, the step 210 of deactivating the self-clean cycle 202 if, as indicated by reference number 215, a burner 106 is active. Thus, for example, if any burner 106 is being operated, such that for example fuel is being supplied to the burner 106, the self-clean cycle 202 may be deactivated. Controller 50 in exemplary embodiments may thus for example deactivate the heating element(s) 40 and/or 42 utilized during the self-clean cycle, such that they no longer supply heat to the chamber 14 and the self-clean cycle 202 is turned off.

A method according to the present disclosure may further include, for example, the step 220 of continuing the self-clean cycle 202 if, as indicated by reference number 225, no burner 114 is active. Thus, if a burner 114 is not active, the controller 50 for example may not send deactivation signals to the heating element(s) 40 and/or 42, and rather may simply allow the self-clean cycle 202 to continue.

In some embodiments, a method according to the present disclosure may further include the step 230 of providing a deactivation warning 232 if a burner 106 is active. Such step 230 may occur, for example, before the deactivating step 210. The warning 232 may be provided, for example, on display 124. Thus, a user of the oven appliance 10 may be able to view and react to the deactivation warning 232. If, for example, the user were to turn off an activated burner 106, the deactivation warning 232 would turn off and the self-clean cycle 202 would continue. In exemplary embodiments, controller 50 may provide the deactivation warning 232, such as to the display 124.

In some embodiments, a method according to the present disclosure may further include the step 240 of initiating a deactivation countdown timer 242 if a burner 106 is active. Such step 240 may occur, for example, before the deactivating step 210. The timer 242 may be provided, for example, on display 124. Thus, a user of the oven appliance 10 may be able to view and react to the timer 242. If, for example, the user were to turn off an activated burner 106 before the timer 242 expired, the deactivation timer 242 would turn off and the self-clean cycle 202 would continue. In exemplary embodiments, controller 50 may provide the deactivation timer 242, such as to the display 124, and may operate the countdown of the deactivation timer 242.

It should be noted that the deactivation warning 232 may be provided for the timer 242 period, or for another suitable predetermined period of time after which the deactivating step 210 may be performed. In exemplary embodiments, the deactivating step is performed after expiration of a predetermined timer 242 countdown period.

In some embodiments, a method according to the present disclosure may further include the step 250 of receiving a signal to activate the self-clean cycle 202. For example, for the self-clean cycle 202 to occur, such cycle 202 must be activated. Thus, for example, a user may operate a user input 122 to activate self-clean cycle 202. Such activation signal may be received by, for example, controller 50.

A method may further include, for example, the step 260 of determining if any of the one or more cooktop burners 106 is active. Such determining step 260 may occur before activating the self-clean cycle 202. Such determining step may be performed similarly to determining step 200 by, for example, determining a position of a knob 114 or alternatively monitoring a switch 134 or 136, fuel line 130, etc. In exemplary embodiments as discussed, controller 50 may perform such determining step 260 in communication with knob 114, etc.

A method according to the present disclosure may further include, for example, the step 270 of not activating the self-clean cycle 202 if, as indicated by reference number 275, a burner 106 is active. Thus, for example, if any burner 106 is being operated, such that for example fuel is being supplied to the burner 106, the self-clean cycle 202 may not be activated. Controller 50 in exemplary embodiments may thus for example simply not send signals to heating element (s) 40 and/or 42 to activate the elements to perform self-cleaning.

A method according to the present disclosure may further include, for example, the step 280 of activating the self-clean cycle 202 if, as indicated by reference number 285, no burner 114 is active. Thus, if a burner 114 is not active, the controller 50 for example may send signals to the heating element(s) 40 and/or 42 to activate and begin heating the chamber 14 to perform self-cleaning.

In some embodiments, a method according to the present disclosure may further include the step 290 of providing a non-activation warning 292 if a burner 106 is active. Such step 290 may occur, for example, before the non-activating step 270. The warning 292 may be provided, for example, on display 124. Thus, a user of the oven appliance 10 may be able to view and react to the deactivation warning 292. If, for example, the user were to turn off an activated burner 106, the deactivation warning 292 would turn off In some embodiments, if the burner is turned off in a pre-determined period of time, the self-clean cycle 202 may then activate. In other embodiments, the user may then be required to again activate the self-clean cycle 202 In exemplary embodiments, controller 50 may provide the deactivation warning 292, such as to the display 124.

It should be understood that the various steps discussed herein may be performed as an open-loop or closed-loop method, and may be performed generally constantly, at predetermined variables, or according to user input and direction as desired or required.

It should further be understood that a controller 50 according to the present disclosure may be operable to perform any one or more of the various steps discussed herein. Accordingly, the present disclosure is thus directed to oven appliances 10 which include such controllers 50, and which controllers 50 are so operable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating an oven appliance, the method comprising:

determining if a cooktop burner is active during operation of a cooking chamber self-clean cycle;

providing, before deactivating the self-clean cycle, a deactivation warning if the cooktop burner is active;

initiating, before deactivating the self-clean cycle, a deactivation countdown timer if the cooktop burner is active;

deactivating the self-clean cycle if the cooktop burner is active; and continuing the self-clean cycle if the cooktop burner is not active.

2. The method of claim 1, wherein the deactivation warning is provided on a display of the oven appliance.

3. The method of claim 1, further comprising receiving a signal to activate the self-clean cycle, and determining if the cooktop burner is active before activating the self-clean cycle.

4. The method of claim 3, further comprising activating the self-clean cycle if the cooktop burner is not active, and not activating the self clean. cycle if the cooktop burner is active.

5. The method of claim 3, further comprising providing a non-activation warning if the cooktop burner is active.

6. The method of claim 1., wherein the determining step comprises determining a position of a knob associated with the burner.

7. A method for operating an oven appliance, the method comprising:

determining if a cooktop burner is active during operation of a cooking chamber self-clean cycle;

displaying a deactivation warning and initiating a deactivation countdown timer if the cooktop burner is active;

deactivating the self-clean cycle if the deactivation countdown timer expires; and continuing the self-clean cycle if the cooktop burner is not active.

8. The method of claim 7, further comprising receiving a signal to activate the self-clean cycle, and determining if the cooktop burner is active before activating the self-clean cycle.

9. The method of claim 8, further comprising activating the self-clean cycle if the cooktop burner is not active, and not activating the self-clean cycle if the cooktop burner is active.

10. The method of claim 8, further comprising providing a non-activation warning if the cooktop burner is active.

11. The method of claim 7, wherein the determining step comprises determining a position of a knob associated with the burner.

12. An oven appliance, comprising:

a cabinet defining a cooking chamber, the cooking chamber configured for receipt of items to be cooked;

a heating element positioned in the cooking chamber and configured for heating the cooking chamber, the heating element operable to perform a self-clean cycle;

a cooktop disposed on the cabinet, the cooktop comprising a cooktop burner;

a controller in communication with the heating element and the cooktop burner, the controller operable to determine if the cooktop burner is active during operation of heating element to perform the self-clean cycle, the controller further operable to deactivate the self-clean cycle if the cooktop burner is active, the controller further operable to, before deactivating the self-clean cycle, provide a deactivation warning and initiate a deactivation countdown if the cooktop burner is active.

13. The oven appliance of claim 12, wherein the oven appliance comprises a display, and wherein the deactivation warning and deactivation countdown are provided on the display.

14. The oven appliance of claim 12, wherein the controller is further operable to receive a signal to activate the self-clean cycle and determine if the cooktop burner is active before activating the self-clean cycle.

15. The oven appliance of claim 14, wherein the controller is further operable to activate the self-clean cycle if the cooktop burner is not active, and not activate the self-clean cycle if the cooktop burner is active.

16. The oven appliance of claim 12, further comprising a knob associated with the cooktop burner, and wherein a position of the knob indicates activity of the cooktop burner.

17. The oven appliance of claim 12, wherein the cooktop burner is a gas cooktop burner.

* * * * *